US006667569B2

(12) United States Patent
In et al.

(10) Patent No.: US 6,667,569 B2
(45) Date of Patent: Dec. 23, 2003

(54) COLOR SELECTION APPARATUS FOR CATHODE RAY TUBE

(75) Inventors: Jun-Kyo In, Suwon (KR); Kwang-Sik Lee, Sungnam (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/957,678

(22) Filed: Sep. 21, 2001

(65) Prior Publication Data

US 2002/0089276 A1 Jul. 11, 2002

(30) Foreign Application Priority Data

Oct. 11, 2000 (KR) ..... 2000-59822

(51) Int. Cl.[7] ..... H01J 29/07; H01J 29/80
(52) U.S. Cl. ..... 313/402; 313/404; 313/405
(58) Field of Search ..... 313/402, 403, 313/404, 405, 407

(56) References Cited

U.S. PATENT DOCUMENTS 5,111,107 A * 5/1992 Kume et al. ..... 313/405
5,214,349 A * 5/1993 Sakata et al. ..... 313/407
5,416,380 A * 5/1995 Horiuchi ..... 313/407
5,488,263 A * 1/1996 Takemura et al. ..... 313/402
5,751,098 A * 5/1998 Ito et al. ..... 313/402
5,870,485 A * 2/1999 Lundgren et al. ..... 381/306
5,946,403 A * 8/1999 Josephson et al. ..... 381/160
6,043,596 A * 3/2000 Lakshmanan ..... 313/402
6,188,169 B1 * 2/2001 Takayanagi ..... 313/407
6,271,624 B1 * 8/2001 Taguchi et al. ..... 313/402

* cited by examiner

*Primary Examiner*—Sandra O'Shea
*Assistant Examiner*—Dalei Dong
(74) *Attorney, Agent, or Firm*—Robert E. Bushnell, Esq.

(57) ABSTRACT

A color selection apparatus for a cathode ray tube, having a panel as a front glass that is formed to be flat, including a pair of supporting members disposed to be separated by a predetermined distance, a pair of elastic members disposed between the supporting members to be coupled with the supporting members, and a mask coupled with the supporting members and formed with a plurality of electron beam passing apertures, the elastic members having a plurality of overlapped plate members, so that it becomes possible to maintain a tension of the mask formed with the plurality of electron beam passing apertures optimally by varying the shapes of the elastic members.

18 Claims, 2 Drawing Sheets

COLOR SELECTION APPARATUS FOR CATHODE RAY TUBE

CLAIM OF PRIORITY

This application makes reference to, incorporates the same herein, and claims all benefits accruing under 35 U.S.C. §119 from an application entitled COLOR SELECTION APPARATUS FOR CATHODE RAY TUBE earlier filed in the Korean Industrial Property Office on Oct. 11, 2000, and there duly assigned Serial No. 59822/2000 by that Office.

BACKGROUND OF THE INVENTION

1. Technical Field

The present invention relates to a color selection apparatus, and more particularly, to a color selection apparatus for a cathode ray tube in which a panel for forming a screen is flat.

2. Related Art

A cathode ray tube (CRT), which is one among various image display devices, has been developed variously according to the demands of the times, and a flat cathode ray tube in which a panel for forming a screen is flat has been most widely used in recent days.

According to the demand of consumers who desire to see images realized by a cathode ray tube of a color television on a bigger screen, the size of the cathode ray tube is becoming larger. That is, the size of the panel on which a screen is realized is becoming larger. In the process, there is a tendency that the cathode ray tube becomes flat by flattening the panel not to be curved in peripheral parts in consideration of the state of the images realized on the periphery parts of the screen.

I have found that some cathode ray tubes and components thereof can cause inconvenience and problems, such as a lack of reliability, for example. Efforts have been made to improve cathode ray tubes and components thereof.

Exemplars of recent efforts in the art include U.S. Pat. No. 5,111,107 for GRID APPARATUS FOR A COLOR CATHODE RAY TUBE WHICH ELIMINATES VIBRATION OF THE GRIDS issued to Kume et al. on May 5, 1992, and U.S. Pat. No. 5,416,380 for COLOR SELECTION MECHANISM FOR CATHODE RAY TUBE AND ARM MEMBER FOR THE SAME issued to Horiuchi on May 16, 1995.

While these recent efforts provide advantages, I note that they fail to adequately provide a convenient and efficient color selection apparatus for a cathode ray tube.

SUMMARY OF THE INVENTION

Accordingly, the present invention is directed to a color selection apparatus for a cathode ray tube that substantially obviates one or more of the problems due to limitations and disadvantages of the related art.

An object of the present invention is to provide a color selection apparatus for a cathode ray tube, which has an additional function for applying continuous and sufficient tension to a mask for substantially carrying out color selection function in a cathode ray tube.

To achieve these and other advantages and in accordance with the purpose of the present invention, as embodied and broadly described, a color selection apparatus for a cathode ray tube includes a pair of supporting members disposed with a predetermined interval, a pair of elastic members disposed between the supporting members and coupled with the supporting members, and a mask coupled with the supporting members and having a plurality of apertures for passing electron beams through, wherein a plurality of plate members are overlapped as elastic members.

In the present invention, the color selection apparatus further includes a vibration-damping element for damping vibration transmitted to the supporting members via the elastic members, wherein the vibration-damping element consists of rubbers disposed between the plate members.

Further, a plate element, which is disposed at a remotest position from the supporting members, is preferably formed of a material of which a thermal expansion coefficient is biggest, and the length of the plate members becomes shorter gradually toward the farthest position from the mask.

To achieve these and other objects in accordance with the principles of the present invention, as embodied and broadly described, the present invention provides a color selection apparatus for a cathode ray tube, the apparatus comprising: first and second supporting members being separated by a predetermined distance; first and second elastic members being disposed between said supporting members, and being coupled with said supporting members; and a mask being coupled with said supporting members, said mask forming a plurality of apertures being penetrated by electron beams; said first elastic member including a plurality of overlapping first plate members, said second elastic member including a plurality of overlapping second plate members.

To achieve these and other objects in accordance with the principles of the present invention, as embodied and broadly described, the present invention provides a method of forming a color selection apparatus for a cathode ray tube, the method comprising: separating first and second supporting members from each other by a predetermined distance; positioning first and second elastic members between said supporting members, and coupling said elastic members to said supporting members; and coupling a mask to said supporting members, said mask forming a plurality of apertures being penetrated by electron beams, said first elastic member including a plurality of overlapping first plate members, said second elastic member including a plurality of overlapping second plate members.

To achieve these and other objects in accordance with the principles of the present invention, as embodied and broadly described, the present invention provides a computer storage medium having stored thereon a set of instructions implementing a method of forming a color selection apparatus for a cathode ray tube, said set of instructions comprising one or more instructions for: separating first and second supporting members from each other by a predetermined distance; positioning first and second elastic members between said supporting members, and coupling said elastic members to said supporting members; and coupling a mask to said supporting members, said mask forming a plurality of apertures being penetrated by electron beams, said first elastic member including a plurality of overlapping first plate members, said second elastic member including a plurality of overlapping second plate members.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENTS

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being abroad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

When a cathode ray tube becomes large-scaled and flattened, a color selection apparatus employed for realizing colors also becomes large-scaled. That is, a shadow mask also becomes large-scaled. However, there are difficulties in the strength when enlarging the shadow mask that is formed by a press process. Therefore, new models of a color selection apparatus need to be employed in such a large-scaled cathode ray tube.

One new color selection apparatus employs a mask, which has a plurality of apertures for passing electron beams through, wherein the less curved mask is not formed by a press process but maintained by a predetermined tension.

Figure 3:
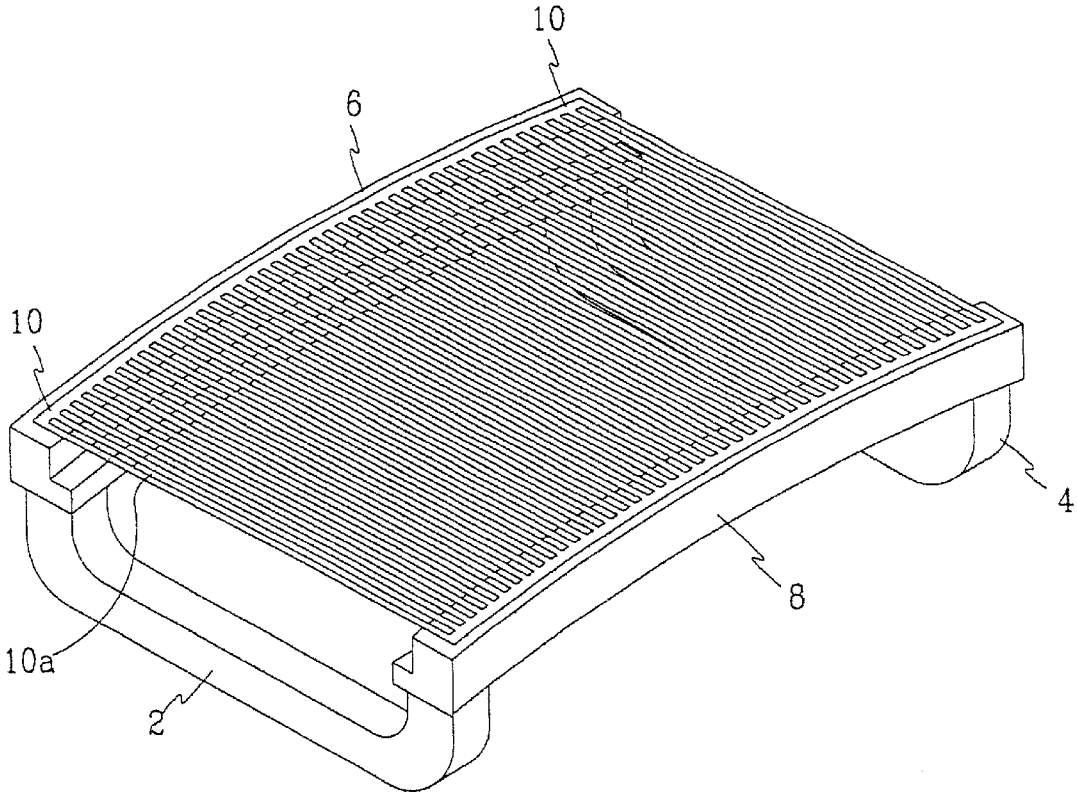
FIG. 3 is a perspective view of a color selection apparatus in which elastic members are mounted.

Referring to FIG. 3 which shows a general color selection apparatus employed in such a large-scaled and flattened cathode ray tube, the color selection apparatus includes a pair of elastic members 2,4, a pair of supporting members 6,8 coupled with the elastic members 2,4, and a flat mask 10 coupled with the supporting members 6,8.

The elastic members 2,4 are formed of a hollow state or a solid state material approximately in the shape of "U". The supporting members 6,8 are longitudinally disposed and connected and fixed to the elastic members 2,4 at both ends by welding.

In the above structure, the mask 10, which has a plurality of electron beam passing holes 10*a*, is welded to the supporting members 6,8. The mask 10 is coupled with the supporting members 6,8 under a predetermined tension substantially applied by the resilient force of the elastic members 2,4.

The color selection apparatus as above is mounted in a panel as a usual shadow mask of a general cathode ray tube for serving to select colors of a plurality of electron beams radiated from an electron gun.

On the other hand, in a flat cathode ray tube employing such a color selection apparatus, it is important to couple the mask 10 with the supporting members 6,8 under a favorable tension, wherein the tension depends on the resilient force applied by the elastic members 2,4. In other words, the tension applied to the mask 10 changes according to the shape of the elastic members 2,4.

The U-shaped elastic members 2,4 are, however, not in the structure for applying sufficient resilient force to the mask 10 since only the side parts of each elastic member 2, 4 are curved. The elastic members 2, 4 have a flat central region and two curved side regions. Even though such elastic members 2,4 may apply some tension to the mask 10 in the beginning, the tension applied to the mask 10 may be weakened due to external conditions as time elapses.

Reference will now be made in detail to a preferred embodiment of the present invention, examples of which are illustrated in the accompanying drawings FIGS. 1 and 2.

Figure 1:
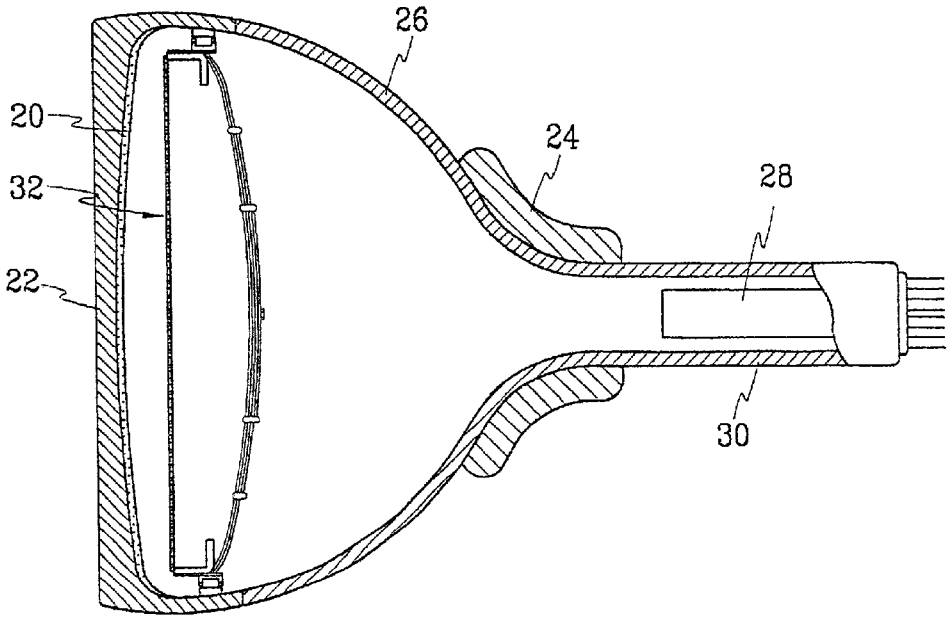
FIG. 1 is a side sectional view of a cathode ray tube employing a color selection apparatus, in accordance with the principles of the present invention.

FIG. 1 is a side sectional view of a cathode ray tube employing a color selection apparatus, in accordance with the principles of the present invention.

As shown in FIG. 1, the cathode ray tube is formed with glass forming a tubular appearance and includes a panel 22 for forming a phosphor screen 20 on an inner surface, a funnel 26 connected to the panel and mounted with a deflection unit 24 on an outer periphery, and a neck 30 connected to the funnel 26 and mounted with an electron gun 28 inside for radiating a plurality of red R, green G, and blue B electron beams to the screen 20.

The cathode ray tube is, as show in FIG. 1, a flat cathode ray tube of which the panel 22 has a flat outer surface, wherein an inner surface of the panel 22 is formed with a predetermined curvature.

Figure 2:
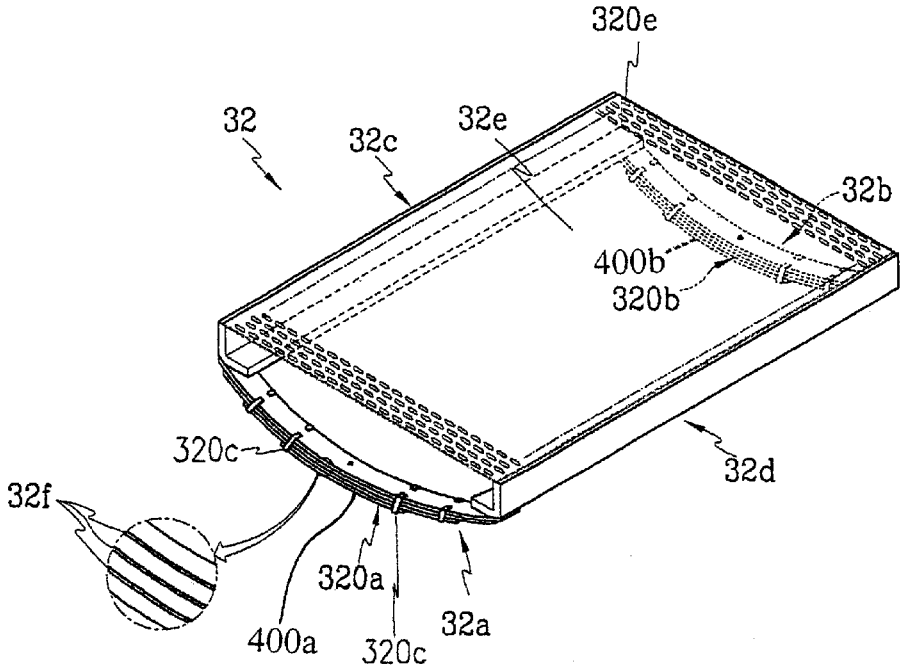
FIG. 2 is a perspective view of the color selection apparatus of FIG. 1, in accordance with the principles of the present invention.

A color selection apparatus 32 which is employed in such a cathode ray tube is mounted in the panel 22 as a shadow mask of a cathode ray tube and selects a plurality of R, G, and B electron beams which are radiated from the electron gun 28, as shown in FIG. 2.

FIG. 2 is a perspective view of the color selection apparatus 32 according to a preferred embodiment of the present invention. In FIG. 2, the color selection apparatus 32 includes a pair of elastic members 32*a*, 32*b*, a pair of supporting members 32*c*, 32*d*, and a mask 32*e* formed with a plurality of apertures 320*e* for passing through the plurality of electron beams.

In the above structure, the elastic members 32*a*, 32*b* are disposed with a predetermined interval for facing each other and form a single coupled body with the supporting members 32*c*, 32*d*. The supporting members 32*c*, 32*d* are formed in the shape shown in FIGS. 1 and 2. The elastic members 32*a*, 32*b* are formed in the shape shown in FIGS. 1 and 2, which is a new and different shape from other ones, and will be described in more detail hereinafter.

The two elastic members 32*a*, 32*b* are formed in the same shape; therefore a single elastic element 32*a* will be explained as an example. First, the elastic element 32*a* is to be formed with a material for maintaining a tension substantially applied to the mask 32*e* in a structure for continuously applying sufficient resilient force to the mask 32*e*, so that a plurality of plate members 320*a* are overlapped in a so-called laminated spring structure.

That is, the elastic member 32*a* consists of plate member 320*a* disposed in such a manner that the plate members disposed in sequence according to their lengths which become shorter in a direction becoming remoter from the mask 32*e*. The plurality of plate members 320*a* are integrally coupled by a coupling element such as a clip 320*c*, and fixed to ends of the supporting members 32*c*, 32*d* at both ends of a plate element disposed close to the mask 32*e*, thereby forming a single assembly with the supporting members 32*c*, 32*d*.

Therefore, the final assembly of the elastic member 32*a* coupled with the supporting members 32*c*, 32*d* is formed with a curvature on the whole as shown in FIG. 2.

The mask 32*e* mounted to the assembly of the elastic members 32*a*, 32*b* and the supporting members 32*c*, 32*d*, is fixed to top surfaces of the supporting members 32*c*, 32*d* in a predetermined tension, wherein the tension of the mask 32*e* is effectively maintained by the elastic members 32*a*, 32*b* which are substantially formed in the laminated spring structure.

In view of geometry, the elastic members 32*a*, 32*b* have a structure that may be more sufficient and with greater continuous tension to the mask 32*e* than the related art.

As above, according to the color selection apparatus for a flat cathode ray tube of the present invention, the mask 32*e* may affect the flat cathode ray tube to carry out the favorable functions by improving the structure of the elastic members 32*a*, 32*b* for maintaining the tension of the mask 32*e*.

In the elastic members 32*a*, 32*b*, the plate members 320*a*, 320*b* formed of a material having the largest thermal expansion coefficient are disposed at a position remotest from the supporting members 32*c*, 32*d*, so that the decrease of the tension of the mask may be prevented by the plate members, which serve as bimetals in the process of heat treatment for preventing the mask from being introduced into a plasticity area.

The plate members 400*a*, 400*b* are furthest from the supporting members 32*c*, 32*d*. The plate members 400*a*, 400*b* are formed of a material with a thermal expansion coefficient that is higher than any thermal expansion coefficient of any one of the other plate members 320*a*, 320*b*. Also, the plate members 400*a*, 400*b* have the shortest length of all the plate members 320*a*, 320*b*.

Further, according to the present invention, an elastic body 32*f* is further inserted between the plate members 320*a*, 320*b* as a vibration-damping element, so that the impact applied to the flat cathode ray tube from the outside may be absorbed and thus may not be transmitted to the mask 32*e* via the elastic members 32*a*, 32*b*, thereby preventing the inferiority of the mask 32*e*. The elastic body 32*f* is formed of rubber which may endure heat of a high temperature, approximately 470 degrees Celsius (470° C.). The elastic body 32*f* also absorbs impact energies generated by the friction between the plate members.

As described hereinabove, according to the color selection apparatus for a cathode ray tube of the present invention, the mask may be always maintained with an optimum tension by the resilient members, so that favorable images may be realized by the flat cathode ray tube when the flat cathode ray tube is operating.

The shape of the elastic members 32*a* and 32*b* is advantageous over the components of the related art. The elastic members 32*a* and 32*b* have a gradual curvature. The composition of the elastic members 32*a* and 32*b* is advantageous over the components of the related art. The elastic members 32*a* are composed of a number of overlapping plates 320*a* which are held together with clips 320*c*. In between the overlapping plates 320*a*, there is inserted elastic bodies 32*f*. The elastic bodies 32*f* can be made of rubber and can absorb shocks and vibrations, so that any shocks or vibrations that arrive at the mask 32*e* will be minimized.

In accordance with the principles of the present invention, a computer can be used in conjunction with the present invention. In particular, instructions on how to form the color selection apparatus of the present invention can be stored on a computer medium. The computer medium could be a magnetic disk used in a hard disk drive, a floppy disk drive, or other drive. The computer medium could be an optical disk used in a compact disc drive. The computer medium can be any medium used to store computer information. The present invention provides a computer storage medium having stored thereon a set of instructions implementing a method of forming a color selection apparatus for a cathode ray tube, said set of instructions comprising one or more instructions for: separating first and second supporting members from each other by a predetermined distance; positioning first and second elastic members between said supporting members, and coupling said elastic members to said supporting members; and coupling a mask to said supporting members, said mask forming a plurality of apertures being penetrated by electron beams, said first elastic member including a plurality of overlapping first plate members, said second elastic member including a plurality of overlapping second plate members.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A color selection apparatus for a cathode ray tube, the apparatus comprising:

first and second supporting members being separated by a predetermined distance;

first and second elastic members being disposed between said supporting members, and being coupled with said supporting members;

a mask being coupled with said supporting members, said mask forming a plurality of apertures being penetrated by electron beams; and a vibration-damping element;

said first elastic member including a plurality of overlapping first plate members, said second elastic member including a plurality of overlapping second plate members, said vibration-damping element being at least one elastic body disposed between at least two of said first plate members.

2. The apparatus of claim 1, with said vibration-damping element damping vibration transmitted to said supporting members through said first elastic member.

3. The apparatus of claim 1, said at least one elastic body being rubber.

4. The apparatus of claim 1, said overlapping first plate members including one plate furthest from said supporting members, said one plate furthest from said supporting members having a thermal expansion coefficient larger than a thermal expansion coefficient of any other ones of said first plate members.

5. The apparatus of claim 1, said overlapping first plate members including one plate furthest from said mask, said one plate furthest from said mask having a length shorter than a length of any other ones of said first plate members.

6. A color selection apparatus for a cathode ray tube, the apparatus comprising:

first and second supporting members being separated by a predetermined distance;

first and second elastic members being disposed between said supporting members, and being connected to said supporting members;

a mask being connected to said supporting members, said mask forming a plurality of apertures being penetrated by electron beams; and at least one vibration damping element;

said first elastic member comprising a plurality of first plate members integrally coupled to provide a resilient force, said first elastic member corresponding to a laminated spring structure, each of said first plate members being curved, with said at least one vibration damping element being disposed between at least two of said first plate members.

7. The apparatus of claim 6, with said first plate members including at least a long plate member at a position closest to said mask and a short plate member at a position furthest from said mask, said long plate member having a larger length than said short plate member, with the lengths of said long and short plate members being measured in a direction from said first supporting member to said second supporting member.

8. The apparatus of claim 6, with at least three of said first plate members having distinguishable lengths, with the lengths being measured in a direction from said first supporting member to said second supporting member.

9. The apparatus of claim 6, with said first plate members being positioned to overlap each other.

10. The apparatus of claim 6, further comprising at least one vibration damping element damping vibration transmitted to said supporting members through said first elastic member.

11. The apparatus of claim 6, with said at least one vibration damping element damping vibration.

12. The apparatus of claim 11, with said first plate members being adjacent to each other, and with said at least one vibration damping element being disposed between adjacent ones of said first plate members.

13. The apparatus of claim 6, with said first plate members including at least a long plate member at a first position and a short plate member at a second position, said long plate member being disposed between said mask and said short plate member, said long plate member being longer than said short plate member as measured in a direction from said first supporting member to said second supporting member.

14. The apparatus of claim 6, with said first plate members being held together with at least one clip.

15. The apparatus of claim 6, with every one of said first plate members having distinguishable lengths, and with the lengths being measured in a direction from said first supporting member to said second supporting member.

16. The apparatus of claim 6, with at least two of said first plate members having distinguishable lengths, with the lengths being measured in a direction from said first supporting member to said second supporting member, and with said first plate members being positioned to overlap each other.

17. The apparatus of claim 16, with said first plate members including at least a long plate member at a first position and a short plate member at a second position, said long plate member being disposed between said mask and said short plate member, said long plate member being longer than said short plate member as measured in a direction from said first supporting member to said second supporting member.

18. The apparatus of claim 17, with said short plate member having a thermal expansion coefficient larger than a thermal expansion coefficient of any other ones of said first plate members.

* * * * *